US005230235A

United States Patent [19]

Smith et al.

[11] Patent Number: 5,230,235

[45] Date of Patent: Jul. 27, 1993

[54] FLAT DIE THREAD ROLLER

[75] Inventors: Gregory A. Smith; Dale E. Foltz; Robert E. Wisebaker, all of Tiffin; Robert E. Loy, Bucyrus, all of Ohio

[73] Assignee: The National Machinery Company, Tiffin, Ohio

[21] Appl. No.: 868,330

[22] Filed: Apr. 14, 1992

Related U.S. Application Data

[62] Division of Ser. No. 652,778, Feb. 8, 1991, Pat. No. 5,131,250.

[51] Int. Cl.[5] ..... B21H 3/06

[52] U.S. Cl. ..... 72/90

[58] Field of Search ..... 72/90, 88, 103, 102, 72/93

[56] References Cited

U.S. PATENT DOCUMENTS

| | | | |
|---|---|---|---|
| 2,967,444 | 1/1961 | Hallberg | 72/90 |
| 3,308,642 | 3/1967 | Morton . | |
| 3,726,118 | 4/1973 | van de Meerendonk | 72/90 |
| 3,926,026 | 12/1975 | Jackson | 72/90 |
| 4,229,966 | 10/1980 | Jackson | 72/90 |
| 4,677,837 | 7/1987 | Jackson | 72/88 |

FOREIGN PATENT DOCUMENTS

| | | | |
|---|---|---|---|
| 309340 | 12/1988 | Japan | 72/88 |
| 986561 | 1/1983 | U.S.S.R. | 72/90 |

*Primary Examiner*—Daniel C. Crane

*Attorney, Agent, or Firm*—Pearne, Gordon, McCoy & Granger

[57] ABSTRACT

A flat die thread rolling machine provides a cam drive for the reciprocating slide which operates through a linkage to cause reciprocation of the slide. The cam provides a dwell which holds the reciprocating die stationary before the commencement of the working stroke to allow insertion of a workpiece into the dies while the dies are stationary relative to each other. The cam produces slow acceleration of the reciprocating die during the initial portion of the rolling operation to prevent workpiece slippage. The working stroke exceeds one-half of the machine cycle. Die match can be adjusted while the machine is running. Separate adjustment means are provided to adjust the tilt, parallelism, and pitch of the dies, with the pitch adjustment permitting pitch adjustment while the machine is running and without affecting tilt and parallelism adjustment. A hydraulic drive is provided to power the machine and provide high torque during jog operations and speed control during normal running operation.

7 Claims, 13 Drawing Sheets

FLAT DIE THREAD ROLLER

This is a division of application Ser. No. 07/652,778, filed Feb. 8, 1991, now U.S. Pat. No. 5,131,250.

BACKGROUND OF THE INVENTION

This invention relates generally to machines for rolling threads, and more particularly to a novel and improved flat die thread roller which provides ease of die adjustment and is capable of operating with improved accuracy so that high quality threads can be consistently produced.

PRIOR ART

Flat die thread rolling machines provide a die pocket in which a stationary die is mounted and a reciprocating slide which carries a reciprocating die back and forth with respect to the stationary die. A pusher or injector operates in timed relationship to the reciprocation of the reciprocating die to inject a blank or workpiece between the dies. On the following stroke of the reciprocating die, the workpiece is rolled along the die faces, and the workpiece material is displaced to form the required thread.

The accuracy of the thread produced depends upon many factors other than the accuracy of the dies themselves. If the support bearings for the reciprocating die wear due to debris entering the bearing area, the movement of the slide is not accurately controlled and the thread quality is reduced. If the dies are not precisely positioned relative to each other, the thread quality is also reduced. For example, it is usually necessary to adjust the die tilt (the relative spacing between the top and the bottom of the die), the parallelism (the relative spacing between the dies along their length), and the pitch spacing (the distance between the dies). Generally in the past, shims of varying thicknesses or relatively crude adjusting means have been used to adjust the relative position of the dies.

Further, it is necessary to adjust the match of the dies so that the grooves rolled into the workpiece by one die register exactly with the ridges on the other die. In order to maintain proper match, it is necessary for the pusher to insert the blank between the dies at exactly the right point in the cycle of the machine. Since the slides of prior machines have generally been driven by a crank mechanism, the maximum acceleration of the reciprocating dies occurs at the end of the stroke. This tends to cause workpiece slippage as the rolling commences. Such slippage tends to produce inconsistent match and consistently high quality threads have been difficult to produce. Also, considerable time and skill have been required to set up the dies even in relatively new machines with no significant wear. Still further, the timing of the pusher has been critical, since the slide reverses direction the instant the end of the return stroke is completed.

SUMMARY OF THE INVENTION

A thread roller in accordance with the present invention combines a number of features which cooperate to consistently produce high-quality threads. The machine is provided with means to adjust the die so that set-up time is substantially eliminated and the skill required for accurate set-up is greatly reduced. Also, many of the adjustments can be performed while the machine is running so that corrective adjustments, required for example when the machine heats up, can be performed while the machine is running to continue the production of high quality threads.

The machine is structured so that wear-producing debris does not collect in the slide bearings. This ensures that the machine can operate with accuracy for longer periods of time. This also permits the use of recirculated slide lubricating fluids where many prior machines have required the use of once-through lubricating fluids.

Further in accordance with this invention, machines for running different sizes of dies have many identical components, which reduces manufacturing costs, since the number of different component parts required for a full line of machines is drastically reduced.

The following are some of the features of this invention which cooperate to provide a machine which consistently produces high quality threads.

A cam drive is provided for the slide reciprocation. The cams operate through a drive lever pivoted on the lower portion of the frame. The lever oscillates around an eccentrically mounted pivot. This lever drive, when compared to conventional crank drives, reduces vertical loads applied to the slide. Also, adjustment of the eccentrically mounted pivot permits the adjustment of die match. In the illustrated embodiment, a hydraulic cylinder is connected to the eccentric pivot so that match adjustment can be performed while the machine is running.

Further, the cam is structured to provide a dwell so that the pusher can insert a workpiece into position between the dies while the reciprocating die is stationary. The cam drive is also structured to provide a low acceleration as the rolling commences. With this cam drive, the pusher operates to consistently and accurately insert the workpiece into the die, and the tendency for workpiece slippage is virtually eliminated. This results in consistent production of high quality threads. Since die match is easily obtained and maintained, high quality production results.

Another feature of this invention involves the bearing structure for the slide. In most prior art machines, the slide is mounted in dovetails, which tend to accumulate wear-causing debris. In the present machine, the slide is supported by bearings which, in effect, suspend the slide from above the dies. The bearing surfaces are protected and the debris does not enter into the running surfaces of the bearing. This results in increased bearing life by minimizing wear. Such structure permits the use of recirculated lubricant, resulting in substantial savings in the cost of lubricant. Also, since the volume of lubricant which must be disposed of is greatly reduced, additional significant savings are realized.

Another important feature of this invention involves the manner in which the slide bearings are positioned and mounted on the machine frame. The mounting includes a pair of pins having tapered ends extending into conical recesses in the bearing block. Adjustment of these pins before the bearing block is locked in position permits precise adjustment of the slide die pocket with respect to the stationary die pocket. This adjustment provides precise die pocket location without requiring excessively close tolerance manufacture and is normally used only during the machine construction. However, it can be a field adjustment during repair or rebuild.

Another important feature of this invention involves the adjustability of the mounting of the fixed or stationary die. Such mounting permits the adjustment of tilt, parallelism, and pitch without the use of shims. Further, the pitch can be easily adjusted without affecting the adjustment of the tilt or parallelism. Also, pitch adjustment can be made while the machine continues to run.

Hydraulic locking is provided for the stationary die. This facilitates quick die changeover. Also, the pusher and separator can be easily exchanged along with relevant portions of the guide tracks along which the workpieces move into the dies. The quick changeover provided by the present machine improves efficiency, since less down-time is encountered during such changeovers.

Another feature of this invention involves the production of machines for different size dies. Typically, different size machines are produced for each die size. For example, if machines are required for five different sizes of dies, generally five machine sizes have been produced. While a machine for a given size die can sometimes be used to run with smaller size dies, full efficiency is not realized in such case.

With the present invention, the production of machines for use with a range of several different die sizes utilizes identical frames and most other component parts. Within such range of die sizes, the principal difference between machines involves the drive cam and the die pocket structure. With the illustrated invention, for example two basic machines are all that is required for use with five different die sizes. By installing the appropriate cam and a small number of other component parts, a machine is provided which efficiently operates for a given die size. Because similar component parts can be used on more machines, production savings are achieved both in the manufacture of the component parts and in the reduction in the inventories of parts required.

Still another feature of this invention involves the use of a hydraulic power drive for the machine. The power drive includes a variable volume pump and a variable volume motor. Under normal operating conditions, the pump is operated at maximum capacity. The speed of the machine is adjusted by adjusting the displacement of the motor. A simple and effective hydraulic circuit is provided for jogging operations. A simple orifice is provided in the control circuit for the pump when jogging is required. The pressure drop occurring across the orifice is used to control the volumetric output of the pump during jogging operation. Further, the motor is operated at maximum displacement during jogging. With this combination, a high torque capacity is provided at a relatively low speed for jogging. The speed of jogging is controlled by the volumetric output of the pump and the torque produced by the motor ensures that maximum torque is available. For normal running operation, however, the simple valve system bypasses the orifice and causes the pump to run at maximum output.

These and other aspects of this invention are illustrated in the accompanying drawings, and are more fully described in the following specification.

DETAILED DESCRIPTION OF THE DRAWINGS

Figure 1:
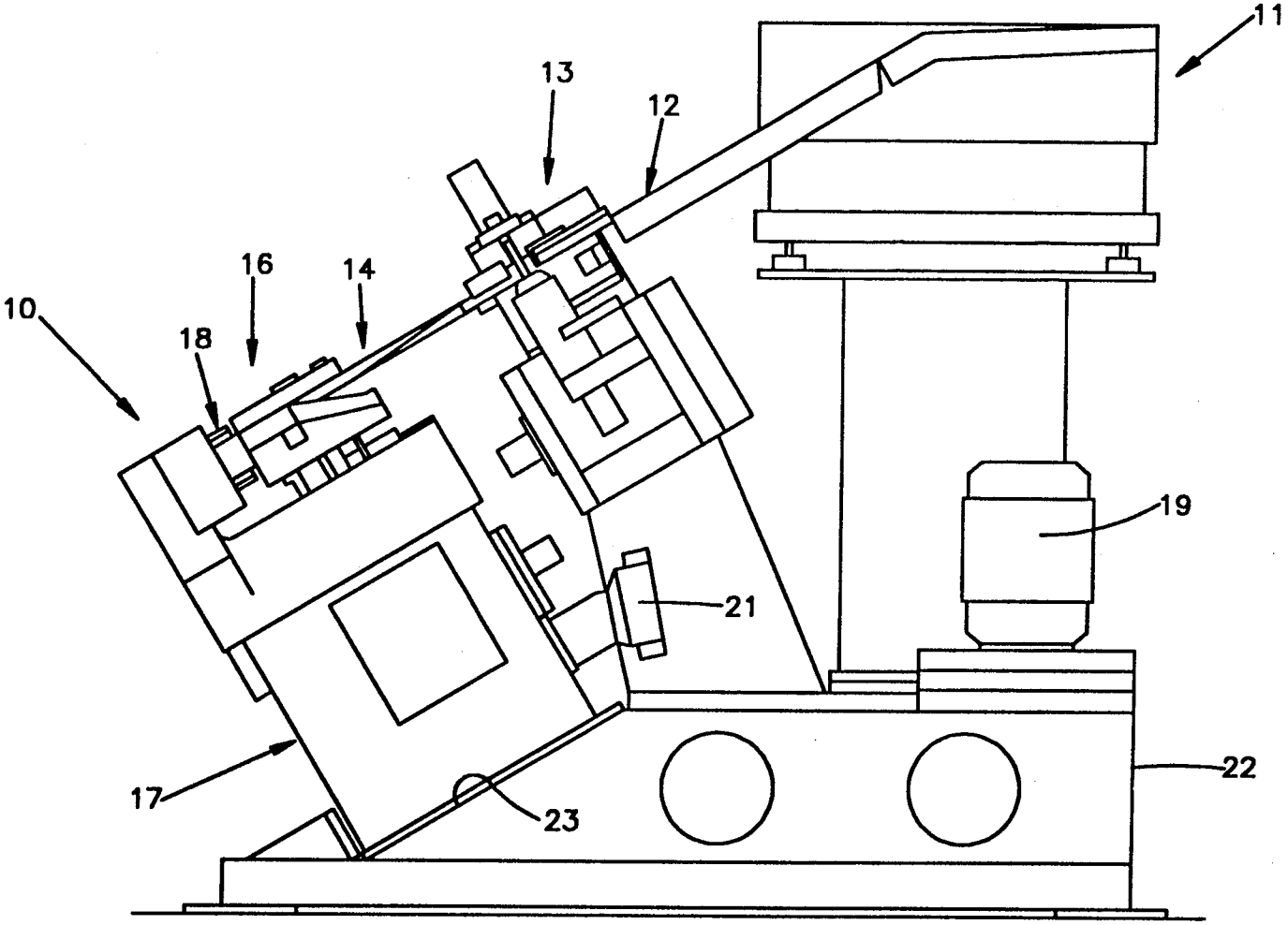
FIG. 1 illustrates a typical installation of a flat die thread roller in accordance with the present invention, in which blanks are fed from a hopper to a pointer, and thereafter feed into the thread roller per se.

FIG. 1 illustrates a typical installation of a thread roller 10 incorporating the present invention. Such installation includes a vibratory feed hopper 11 operable to orient and feed blanks or workpieces into a first feed chute 12 to a pointer 13. After the pointer has trimmed the ends of the blanks which are subsequently threaded, the blanks move along a second feed chute 14 to the threader 10, wherein threads are rolled onto the blank by reciprocating, flat thread rolling dies. In instances in which the blanks do not need to be pointed, the pointer 13 need not be utilized, and the blanks feed directly from the feed hopper 11 to the thread roller 10.

The thread roller, per se, includes a stationary die support and blank feed assembly 16 mounted on the machine frame 17 and a reciprocating slide 18 mounted on the frame 17. A movable die carried by the reciprocating slide moves back and forth relative to a stationary die on the frame through repeated cycles, including a working stroke and a return stroke. The assembly 16 provides the feed system, which includes a separator and a pusher or injector (described in detail below) which operates in timed relationship to the reciprocation of the die to inject blanks into the dies for threading.

The power for the thread roller is provided by a hydraulic system, including a pump driven by an electric motor 19 and a hydraulic motor 21 which is connected to drive the various components of the thread roller. As illustrated, the thread roller itself is mounted in an inclined position on a base 22 which contains the pump and the reservoir for the hydraulic system. Preferably, the base provides an inclined mounting portion 23 so that the frame 17 and the various component parts of the thread roller can be manufactured in a square configuration and then mounted in the inclined position.

Figure 2:
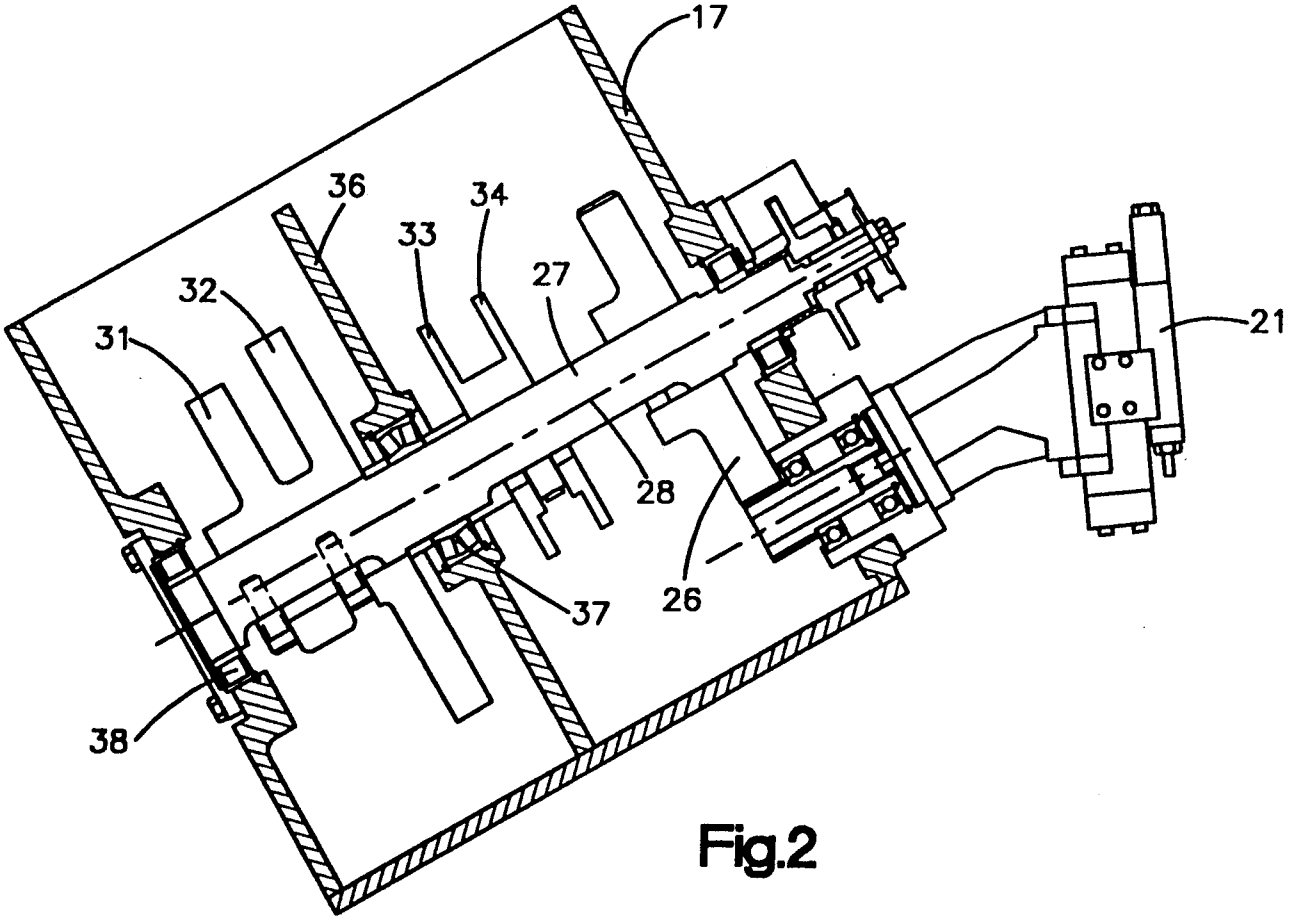
FIG. 2 is a fragmentary cross section illustrating the hydraulic motor and the main drive shaft of the machine with the drive cams mounted thereon.
Figure 3A:
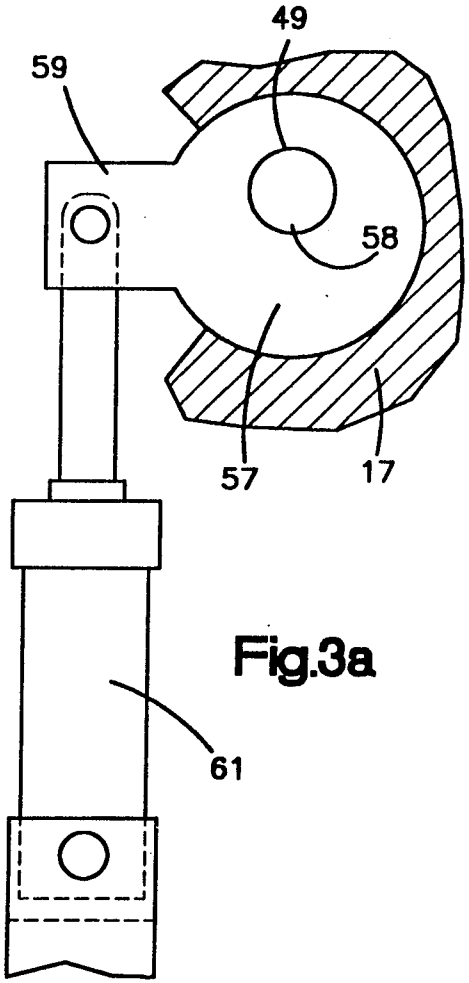
FIG. 3*a* schematically illustrates the eccentric mounting of the drive lever pivot which is operated to adjust die match.
Figure 3:
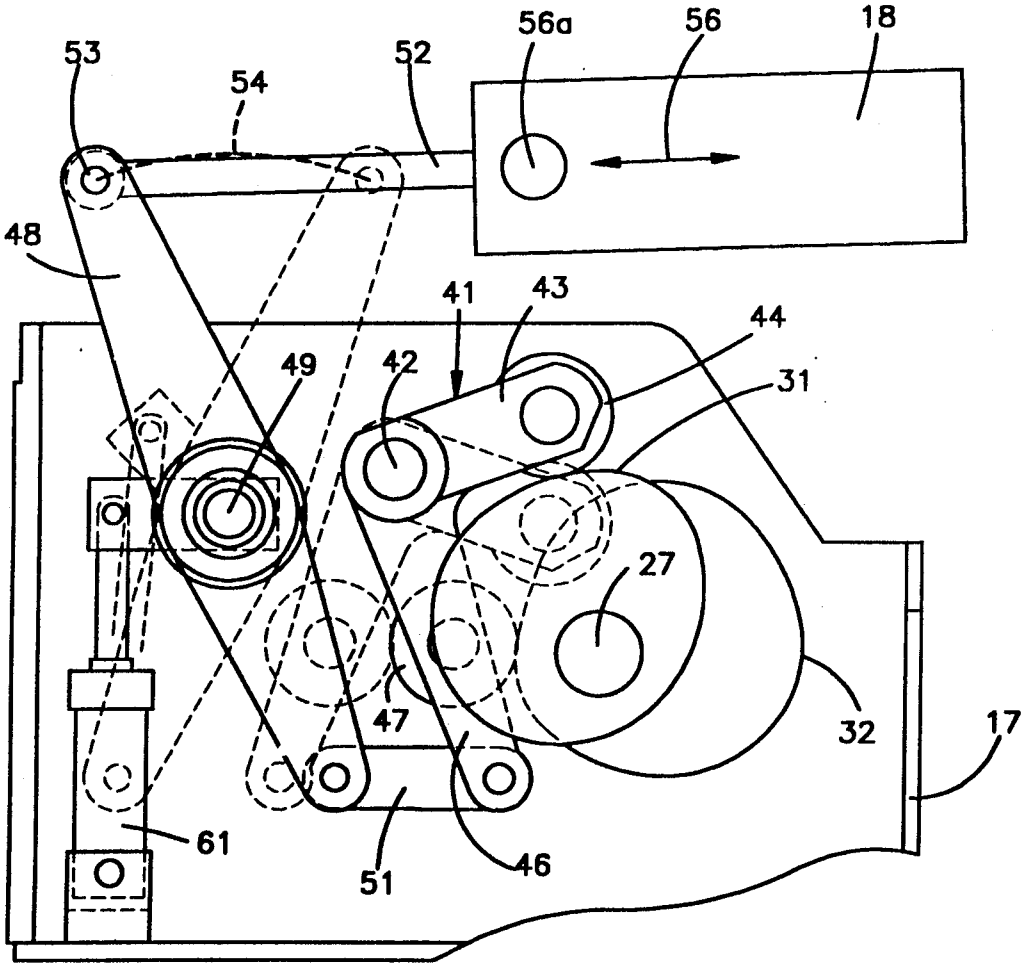
FIG. 3 is a schematic, fragmentary view illustrating the cam drive and follower linkage utilized to drive the reciprocating slide of the machine.
Figure 4:
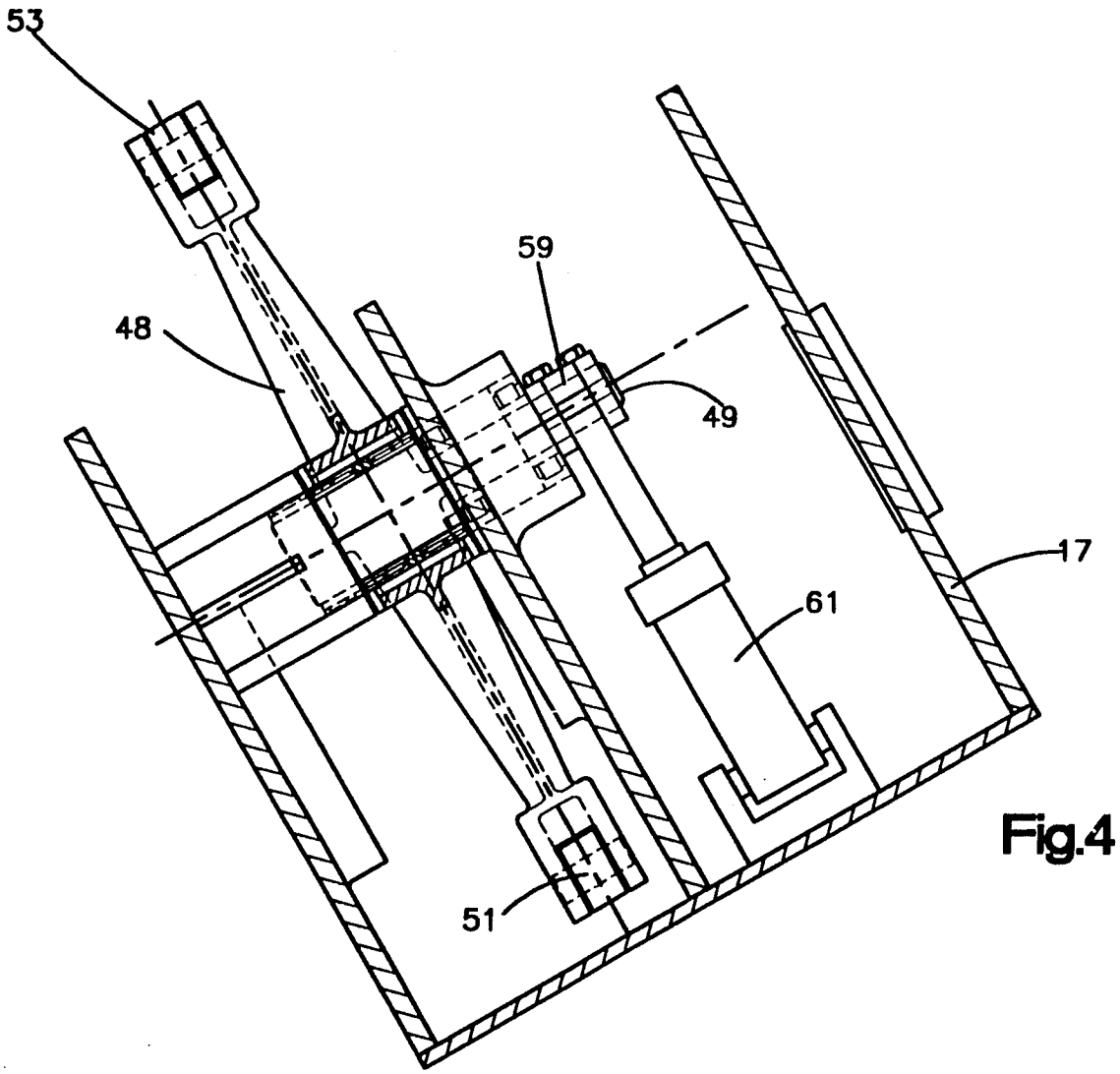
FIG. 4 is a fragmentary vertical section illustrating the piston and cylinder actuator connected to adjust the eccentric position of the pivot for adjusting die match.

Reference should now be made to FIGS. 2 through 4, which illustrate the drive system for the slide. The hydraulic motor 21 is connected by reduction gearing 26 to a camshaft 27 journaled on the frame 17 for rotation about an axis 28. Mounted on the camshaft are four cams. A first pair of cams 31 and 32 are slide drive cams which operate through a follower linkage to produce the reciprocation of the reciprocating slide 18. The cam 33 operates to power the pusher or injector for injecting the blanks into the dies for threading. The cam 34 operates a separator, which functions to separate a single blank from the blank supply and to position such blank in alignment with the pusher. Preferably, the frame 17 provides a center wall 36 in which a center bearing 37 is mounted substantially adjacent to the slide drive cams 31 and 32. Such bearing 37 cooperates with an outboard bearing 38 to provide close-in support of the camshaft adjacent to the drive cams 31 and 32, since such drive cams are subjected to substantial loads.

FIG. 3 schematically illustrates the cam follower linkage which connects the slide for reciprocation in response to rotation of the two cams 31 and 32. This linkage provides positive driving of the slide 18, schematically illustrated in FIG. 3, in both directions. Such linkage includes a compound follower arm 41 journaled on the frame 17 by means of a pivot shaft 42. The compound follower arm provides a first arm 43 supporting a cam follower roller 44 which engages the drive cam 31. The compound follower arm 41 also includes a second arm 46 on which a second follower roller 47 is mounted for engagement with the cam 32. The two cams 31 and 32 are shaped so that full contact is maintained at all times between each of the cams 31 and 32 and its associated roller 44 and 47. Therefore, positive driving is provided at all times. As the two cams 31 and 32 rotate, the compound follower arm 41 is caused to oscillate back and forth around the pivot shaft 42 from the full-line position to the dotted-line position.

A drive lever 48 is journaled on an eccentrically mounted pivot shaft 49. A lower link 51 is pivotally connected between the follower arm 46 and the lever 48 so that oscillating rotation of the compound follower arm 41 causes the lever 48 to oscillate about its pivot shaft 49. An upper link 52 is pivotally connected between the upper end of the lever 48 and the slide 18 to provide the drive connection therebetween, which causes the reciprocation of the slide 18 in response to the oscillating rotation of the lever 48. With this drive linkage, the lateral loads applied to the slide by the upper link 52 are minimized and are much smaller than the lateral loads applied to the slide by a typical crank and pitman drive of the prior art.

The dotted arc 54 represents the locus of movement of the axis of the pivot 53 during the reciprocating oscillation of the lever 48. Since the oscillating rotation of the arm is symmetrical about a mid-position in which the lever 48 is perpendicular to the line of action of the upper link 52, the vertical displacement of the pivot 53 is small. Further, it is preferable to arrange the structure so that the line of action represented by the arrow 56 of the pivot **56*a* connecting the slide to the upper link 52 extends along a line which is halfway between the maximum upper and lower positions of the pivot 53**. This structure minimizes the lateral loads on the slide produced during the reciprocating driving of the slide. Therefore, the lateral loads applied to the guide bearings for the slide are minimized and bearing wear is minimized.

The match of the dies is adjusted by the eccentric mounting of the pivot shaft 49, as schematically illustrated in FIG. **3*a*. A pivot support 57 is supported on the machine frame 17 for pivotal movement about an axis 58. The pivot shaft 49 is eccentrically mounted on the support 57. Preferably, the axis of the pivot shaft 49 is directly above the pivot axis 58 when the eccentric system is in a mid-position within the adjustment range so that adjustment of match does not produce significant vertical movement of the lever 48. The eccentric support 57 is provided with an arm 59 connected to a piston-and-cylinder actuator 61. When it is necessary to adjust the position of the slide to the right as viewed in FIGS. 3 and 3*a*, the actuator 61 is operated to rotate the eccentric support 57 in a clockwise direction, causing movement of the pivot shaft to the right, as illustrated in those figures. When die match requires adjustment of the position of the slide to the left as viewed in FIGS. 3 and 3*a*, the actuator 61 is operated to rotate the eccentric support 57** in an anticlockwise direction, causing the pivot shaft to move to the left as viewed in those figures.

With this structure, adjustment of die match is accomplished easily by merely operating the actuator 61 with suitable fluid controls to adjust the position of the pivot shaft 49, and in turn the position of the slide. Adjustments of die match can be performed while the machine is running.

U.S. Pat. Nos. 3,139,776 and 3,496,581 illustrate a crank and pitman slide drive which utilizes a lever to reduce lateral loads applied to the slide. Such patents, which are assigned to the assignee of this invention, are incorporated herein by reference to illustrate such prior art drive. Machines of the type illustrated in the latter of such patents incorporated an eccentric pivot at the lower end of the lever to adjust die match. However, die match could not be made while the thread roller was operating.

Figure 5:
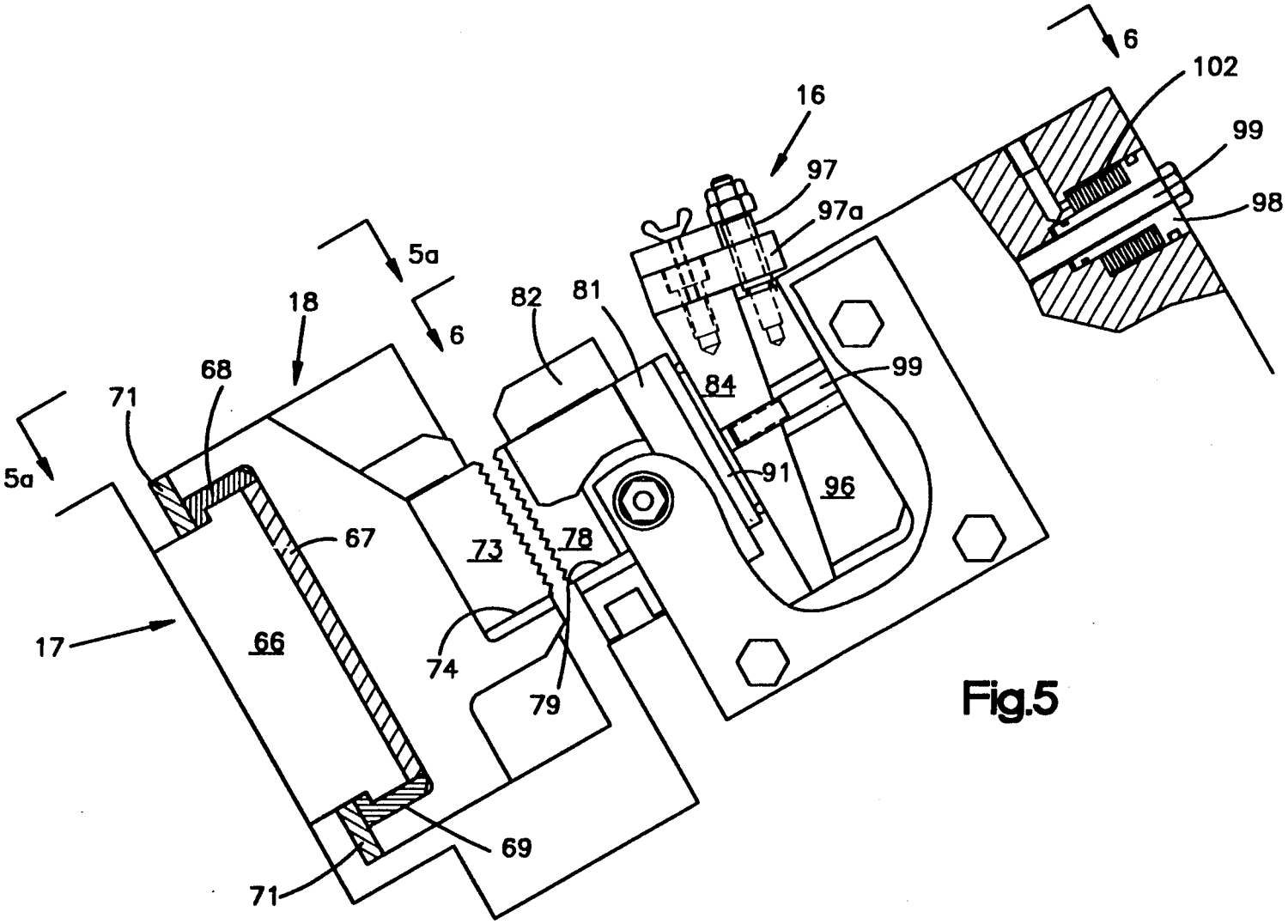
FIG. 5 is a fragmentary side elevation illustrating the support for the reciprocating slide and structure for adjusting the position of the dies, with some parts broken away to better illustrate the structural detail.

FIG. 5 illustrates the bearing structure for supporting and guiding the slide back and forth through the working and return strokes. Mounted on the machine frame 17 is a bearing block 66 having bearing liners 67, 68, and 69 mounted thereon and extending lengthwise thereof to provide bearing surfaces for the slide 18. Mating surfaces are provided on the slide 18 so that the slide is guided in its reciprocating movement. Gibs 71 mounted on the slide 18 trap the slide to ensure that it remains on the bearing liners. However, running clearance is provided between the gibs 71 and the adjacent parts of the liners 68 and 69. Similarly, running clearance is provided between the liners 69 and the adjacent portion of the slide.

Because the slide is mounted in an inclined position, gravity maintains contact between the surface of the liners 67 and 68 and the mating bearing surfaces of the slide 18. With this structure, the position of the slide is determined by the engagement between the surfaces of the liners 67 and 68 and the mating surfaces of the slide 18. In effect, the slide hangs in position from the top of the slide rather than being supported from a bearing system adjacent to the lower end of the slide.

This structure, in which the slide is effectively positioned from above, results in substantially greater running life of the bearings, since sludge and/or the like accumulated from the coolant does not collect in areas of the bearing system which determine the running position of the slide. In fact, with this structure, die coolant sludge does not enter the positioning portions of the slide bearings, so it is practical to utilize recirculating lubricant.

Figure 5B:
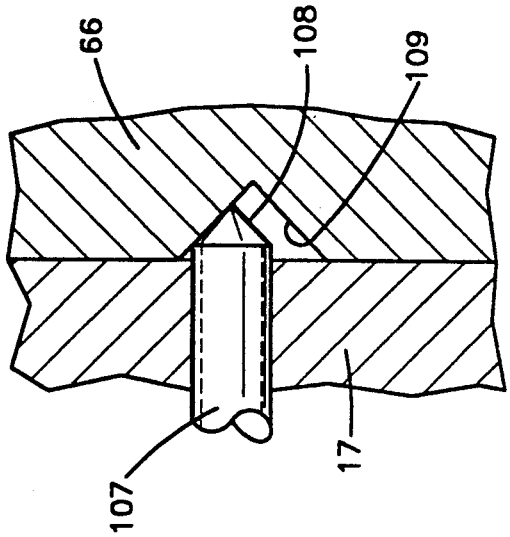
FIG. 5*b* is a fragmentary section, taken along line 5*b*—5*b* of FIG. 5*a*, illustrating the conical pins for adjusting the position of the reciprocating slide bearing support during manufacture to provide exact positioning of the slide die pocket relative to the fixed die pocket.
Figure 5A:
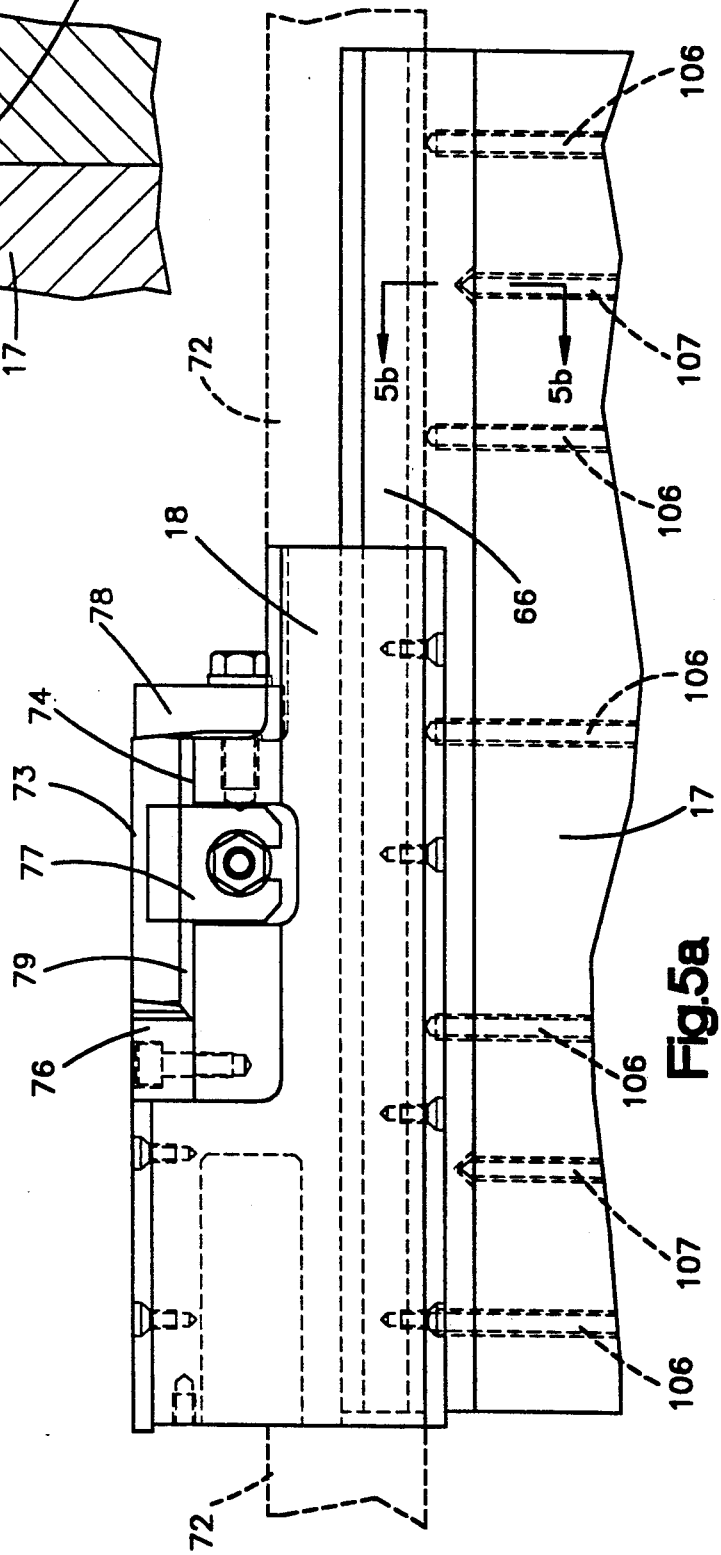
FIG. 5*a* is a fragmentary section taken along line 5*a*—5*a* of FIG. 5, illustrating the die block mounting.
Figure 6:
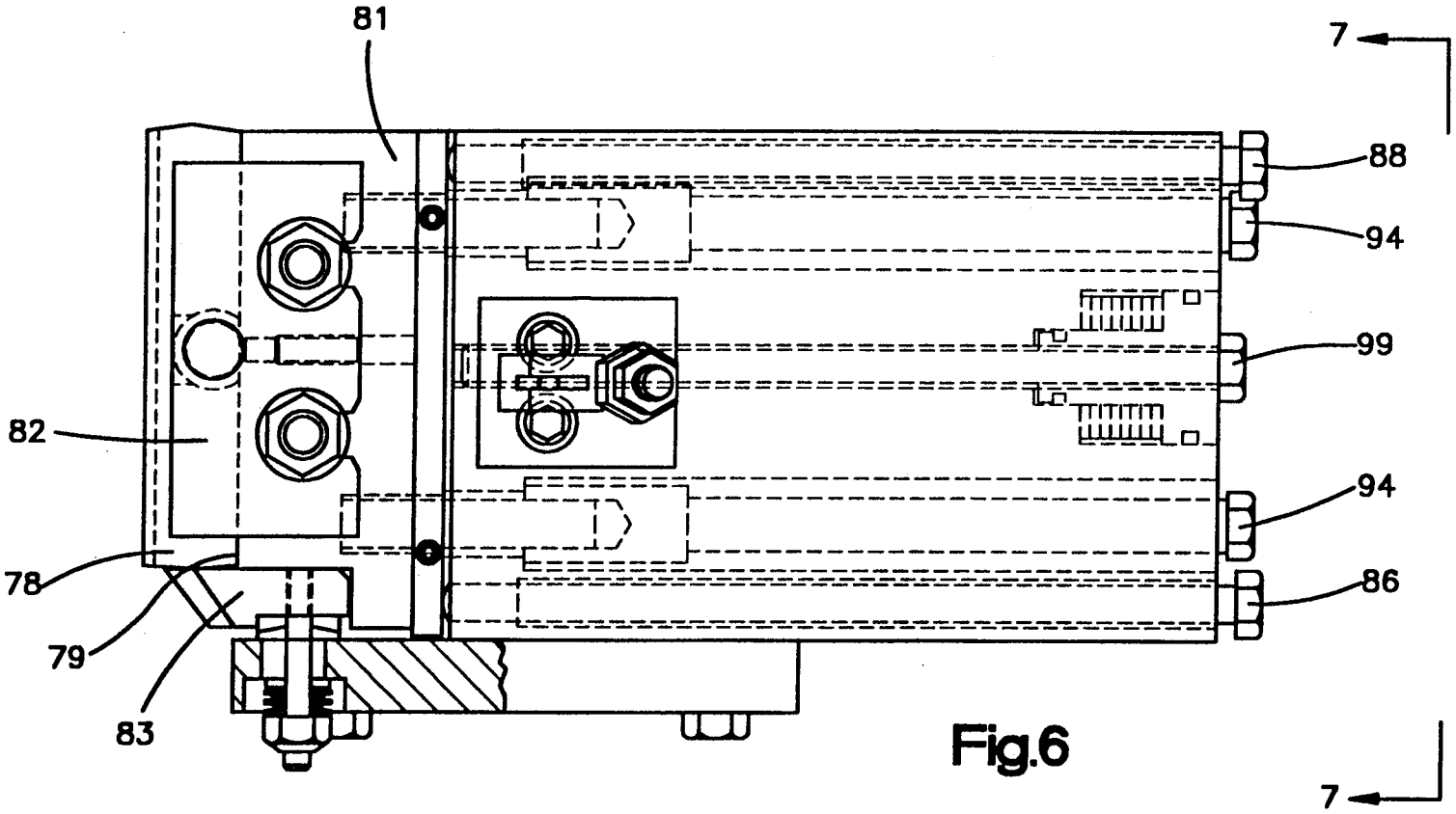
FIG. 6 is a fragmentary plan view, taken along line 6—6 of FIG. 5. Illustrating the fixed die adjustment structure.

As schematically illustrated in FIG. 5*a*, covers 72 are mounted on the slide to cooperate with the slide per se to shield the bearing surfaces from coolant and/or sludge generated by the dies. Such covers are conventionally employed on thread rolling machines, so they need not be specifically illustrated herein.

Referring again to FIG. 5*a*, the reciprocating die 73 is mounted in the die pocket 74 in the slide 18 by clamped elements 76, 77, and 78. Because of the various adjustments provided in the machine incorporating the present invention, it is not necessary to utilize shims and the like to adjust the position of the die 73 within the die pocket 74. However, it is typical to provide a spacer 79 for a given size die to ensure that the face thereof is properly positioned with respect to the face of the slide.

FIGS. 5*a* and 5*b* illustrate an adjustment that is used during the manufacture of the machine to ensure that the vertical position of the die pocket in the slide exactly matches the vertical position of the die pocket for the stationary die. This adjustment is provided to eliminate the need for extremely close tolerance manufacture, and is normally not a field adjustment.

The bearing block 66 is clamped to the frame 17 by a plurality of bolts 106. Prior to tightening of such bolts to lock the bearing block 66 in position, adjusting screws 107 substantially adjacent to the ends of the bearing block 66 are adjusted to raise or lower the associated end of the bearing block to obtain exact positioning of the die pocket 74 in the slide relative to the die pocket for the stationary die.

Each of the screws 107 is provided with a conical end 108 which projects into a conical recess 109 formed in the rearward face of the bearing block 66, as best illustrated in FIG. 5*b*. The conical recess 109 is larger than the cone end 108 on the screw 107. Therefore, if the adjacent end must be raised, the screw is threaded in and functions to cam the adjacent end of the bearing block in an upward direction. Conversely, if the adjacent end should be lowered, the screw 107 is threaded back, allowing the adjacent end of the bearing block to drop down. While this adjustment is occurring, the lock bolts 106 are sufficiently loose to allow such movement, but are sufficiently tight to maintain contact between the rearward face of the bearing block 66 and the frame 17. After positioning has been completed, the bolts 106 are all tightened to permanently lock the bearing block in its adjusted position. This structure is primarily an aid to be used in the manufacture of the machine, and is normally not a field adjustment. However, if bearing liners must be replaced for any reason, the adjustment can be used to reestablish the exact positioning of the bearing and slide.

Reference should now be made to FIGS. 5 and 6 through 8, which illustrate the mounting and adjusting structure for the fixed die 78. The fixed die 78 is secured in a fixed die pocket 79 formed in the die block 81 by die clamps 82 and 83. The die block is, in turn, supported within the machine frame in a manner permitting the position of the die block to be adjusted for die tilt, parallelism, and spacing. Further the adjustment structure is arranged so that the pitch spacing can be adjusted without altering the tilt and parallelism adjustment.

Figure 7:
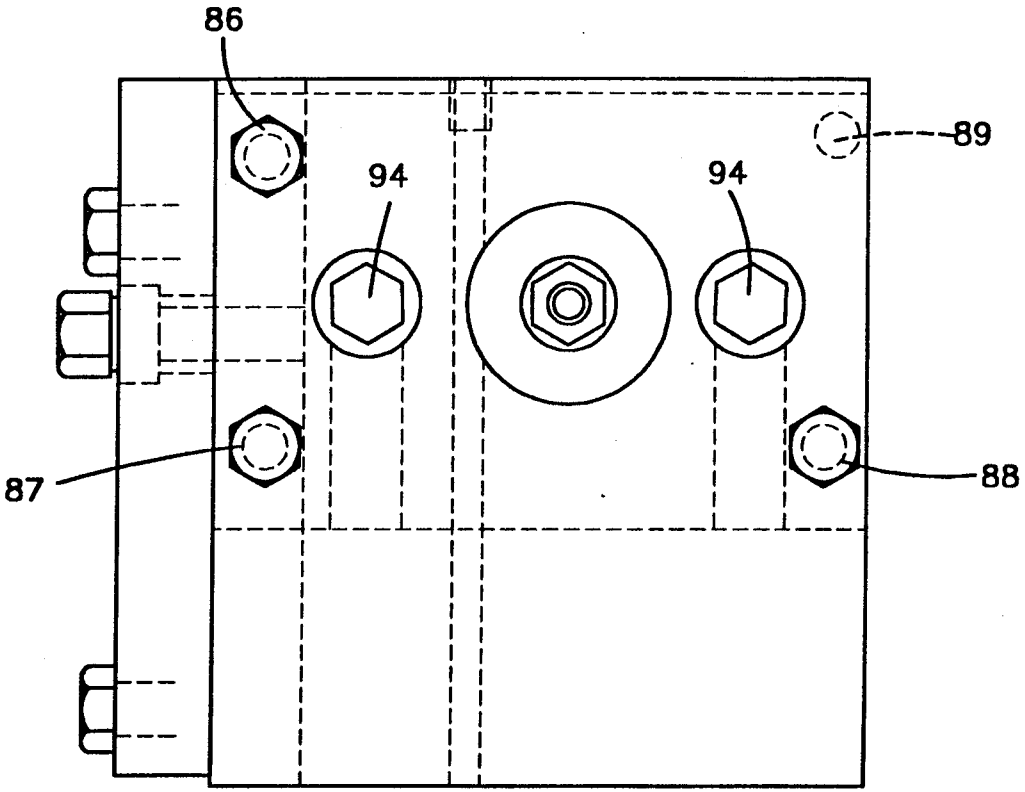
FIG. 7 is a fragmentary end elevation taken along line 7—7 of FIG. 6.
Figure 8:
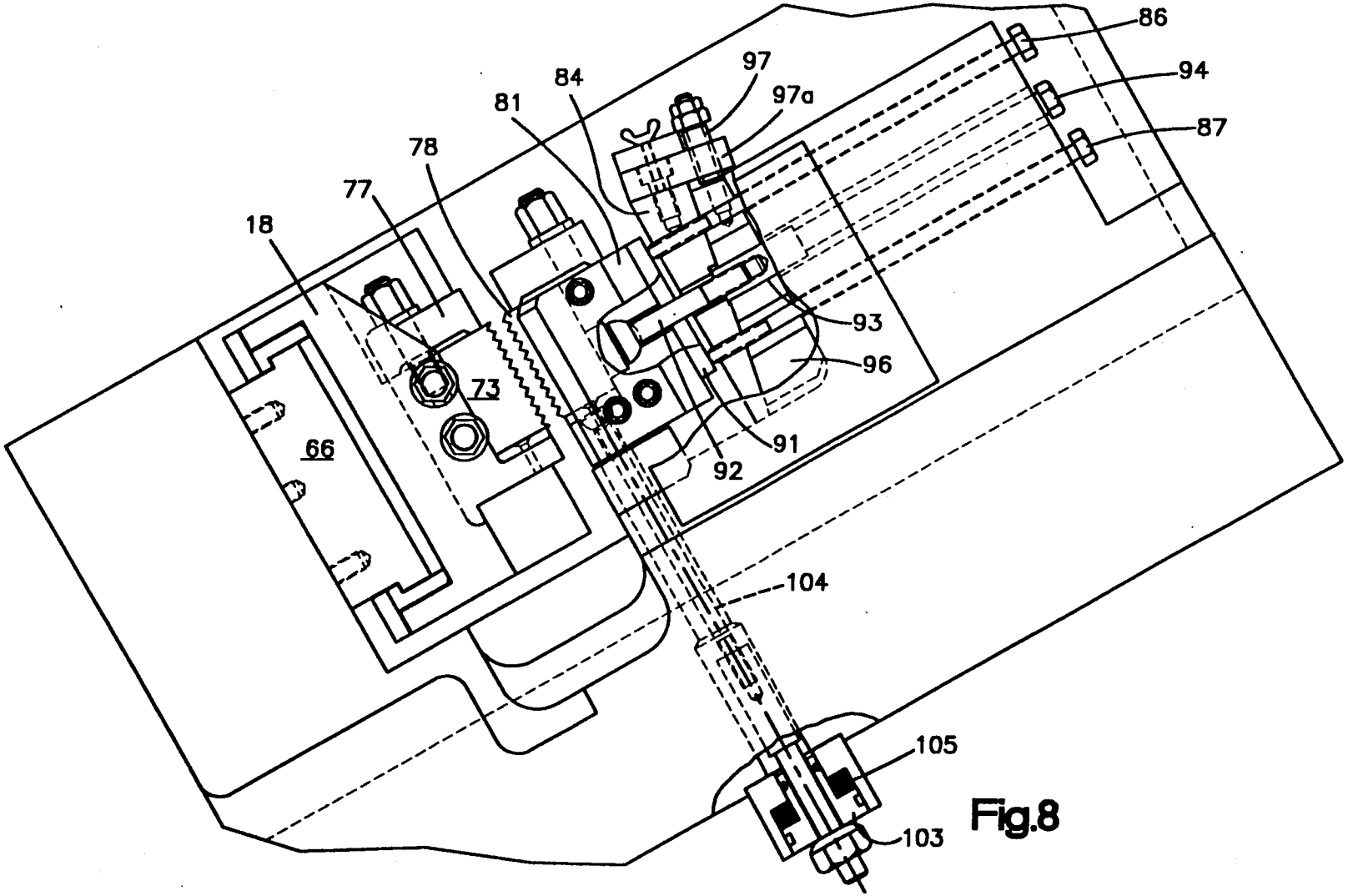
FIG. 8 is a fragmentary, vertical section illustrating the structure for adjusting the die tilt and parallelism.

Referring to FIGS. 5, 7, and 8, the die block 81 is adjustably positioned with respect to a wedge-shaped backing plate 84 by three adjusting screws 86, 87, and 88, and a fixed pin 89. The three screws 86, 87, and 88 are threaded into the backup plate 84 and bear at their inner ends against a spacer plate 91 mounted on the rearward face of the die block 81. The fixed pin 89 (illustrated in FIG. 7) is permanently mounted in the backup plate 84 and also engages the rearward face of the spacer 91.

When it is desired to adjust the tilt of the die block 81 and, in turn, the tilt position of the fixed die 78 relative to the movable die 73, the lower two screws 87 and 88 are threaded in or out to produce such adjustment. If the lower edge of the die is to be moved in closer to the movable die 73, these two screws 87 and 88 are threaded inwardly. Conversely, adjustment of the tilt of the dies in the opposite direction to increase the spacing between the lower edges of the two dies is accomplished by threading the two screws 87 and 88 back with respect to the backup plate.

Adjustment of the parallelism of the two dies is accomplished by threading the two screws 86 and 87 in or out. With this simple structure, which includes the three screws 86 through 88 and the fixed pin 89, it is possible to provide both tilt and parallelism adjustment of the dies without the need for the use of shims and the like.

After the tilt and parallelism adjustment is completed, the die block 81 is tightly clamped and locked in position against the ends of the adjusting screws and the pin by two clamping structures (illustrated in FIG. 8) each including a lock bolt 92 threaded into a tube nut 93. The inner end of the lock bolt is formed with a spherical head which mates in a spherical seat within the die block 81 to accommodate changes in the tilt and parallelism position of the die block with respect to the backup plate 84. Each tube nut 93 bears against a shoulder on the backup plate 84, and is provided with an extension 94. The extensions 94 provide accessible hex heads to rotate the tube nuts in either direction for clamping or release of the clamping force provided by the associated lock bolt. The lock bolt extends through clearance openings in the die block and backup plate so that a limited amount of movement is accommodated.

The two clamping assemblies, each including a lock bolt 92, a tube nut 93, and an extension 94, are positioned adjacent to either side of the die block 81 so that when the lock bolts are tightened to tightly clamp the die block against the adjusting screws and pins, they do not impose substantial bending loads on the die block.

Pitch adjustment of the dies is provided by a wedge 96 positioned between the backup plate 84 and the machine frame. The wedge 96 is vertically adjustable by means of a bolt 97 extending through a plate 97*a* secured to the upper end of the backup plate 84. When it is necessary to reduce the spacing between the two dies 73 and 78, the wedge 96 is adjusted in an upward direction, causing movement of the backup plate 84 to the left, as illustrated in FIGS. 5 and 8. This reduces the pitch diameter of the workpieces being threaded. Conversely, when an increased spacing is required, the wedge is adjusted in a downward direction to increase the spacing between the two dies.

Once the wedge is adjusted, it is locked in position hydraulically by a piston assembly 98 at the head of a clamping bolt 99 The clamping bolt 99 is threaded into the backup plate 84 and when hydraulic pressure is applied to the piston 98 through a port 101, the clamping bolt 99 operates to tightly clamp the backup plate against the wedge 96 in the adjusted position. Since the tilt and parallelism position of the die block is determined solely with respect to the backup plate 84, adjustment of the pitch spacing of the dies by the wedge 96 does not in any way affect the tilt and parallelism adjustment.

In order to ensure that the backup plate 84 is held against the wedge, even during adjustment of the wedge, a series of Belleville-type disc springs 102 are positioned around the piston 98 to maintain a minimum tensile force in the clamping bolt 99 even when hydraulic pressure is not applied to the piston 98. With this structure, adjustment of pitch can be accomplished even when the machine is running by merely releasing the hydraulic pressure on the piston 98 to reduce the clamping force to a level which permits vertical adjustment of the wedge. The minimum force established by the disc springs 102 is sufficient to maintain contact along the faces of the wedge. However, after the wedge is adjusted to appropriately adjust the pitch spacing between the dies, hydraulic pressure is again applied to reclamp the backup plate back against the wedge and, in turn, clamp the wedge against the machine frame.

A second hydraulic piston 103 is provided to clamp the die block in a vertical position against a supporting surface on the frame, as best illustrated in FIG. 8. This piston is connected through a clamping bolt 104 to the die block. The clamping bolt 104 is provided with a spherical inner end mating with a spherical recess in the die block so that the die block can be adjusted in tilt without restriction. Here again, Belleville-type disc springs 105 are provided to maintain a minimum clamping force holding the die block down against a supporting surface during adjustment, but the clamping force is increased with hydraulic pressure applied to the piston 103 during normal operation of the machine. Consequently, pitch adjustment of the dies can be performed while the machine is running by releasing the hydraulic pressure on the two pistons 103 and 98 during adjustment itself, and then reinstituting full clamping by supplying hydraulic pressure to the two pistons for normal operation.

Figure 9:
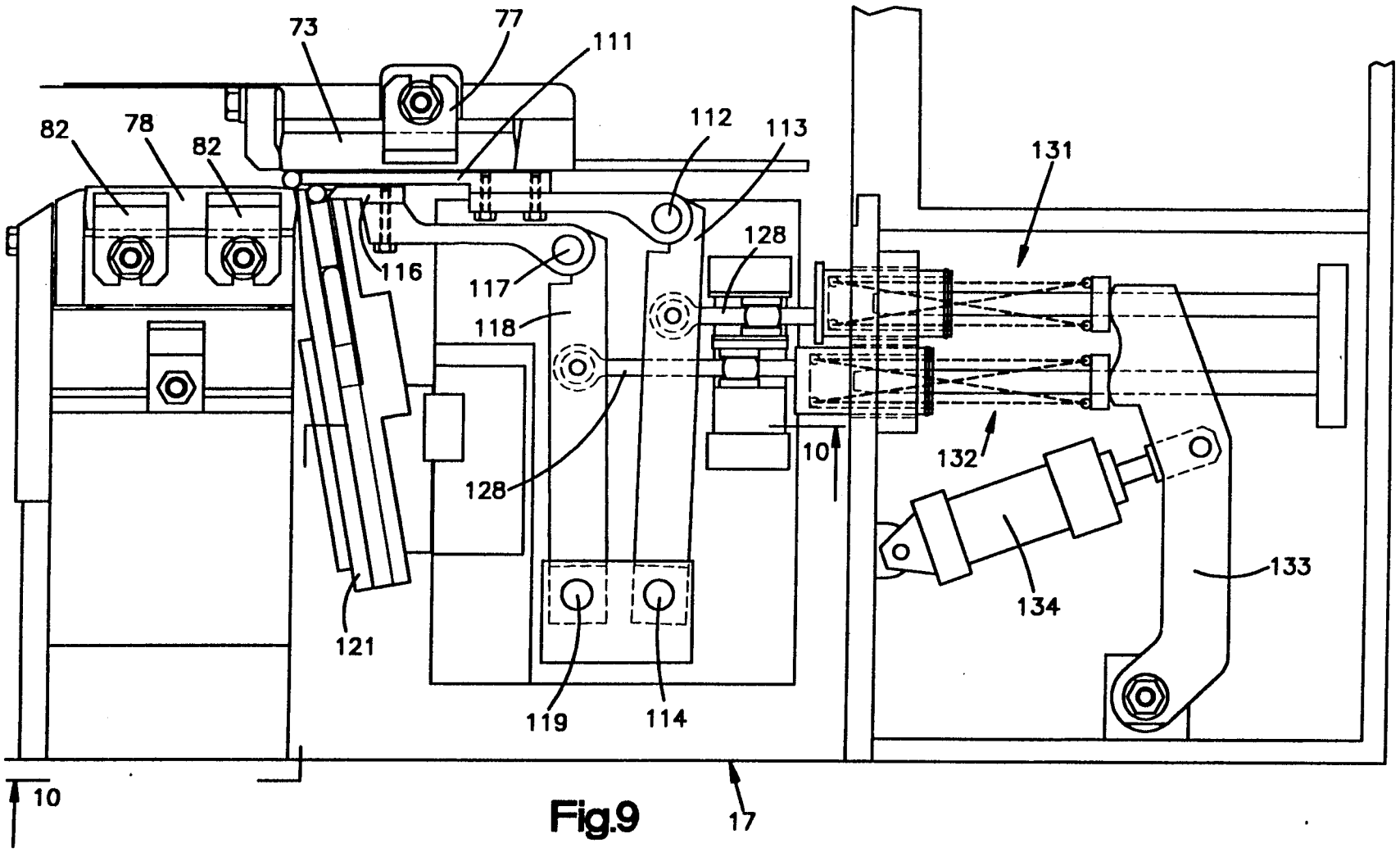
FIG. 9 is a plan view illustrating the drive for the separator and the injector or pusher.
Figure 10:
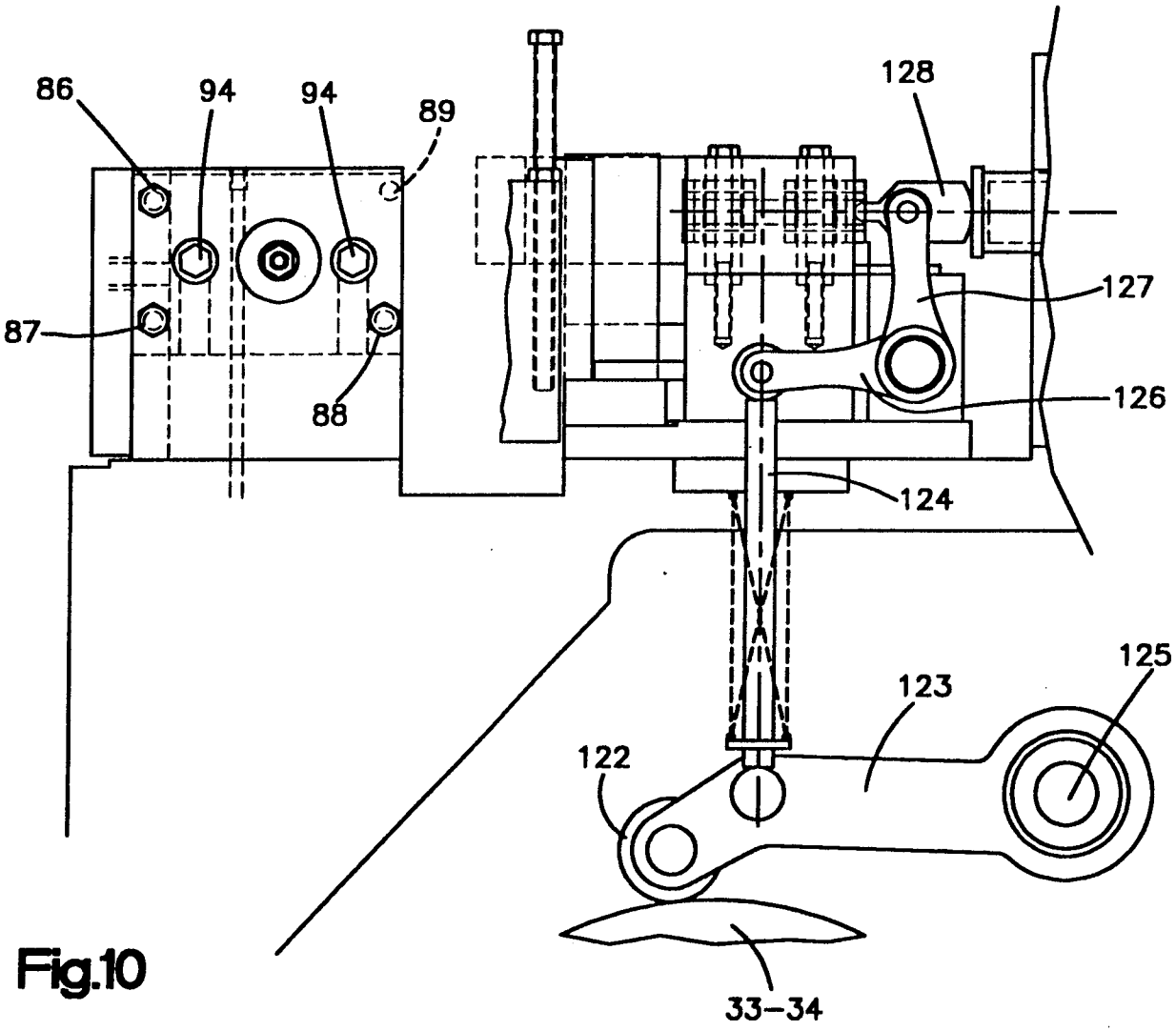
FIG. 10 is a fragmentary section, taken generally along the broken section line 10—10 in FIG. 9, illustrating the cam follower linkage for driving the separator and pusher or injector.

FIGS. 9 and 10 best illustrate the structure and drive for the pusher and separator. The pusher 111 is mounted by a pivot 112 on the end of a lever 113. This lever 113 is mounted at its other end on the machine frame 17 by a pivot 114. The separator 116 is connected by a pivot 117 to a lever 118. Here again, the lever 118 is connected by a pivot 119 to the frame 17 of the machine. In operation, blanks enter the machine along a feed chute assembly 121. The separator 116 is movable to a position blocking the feed chute, and is provided with an inclined end face which functions to cam a single blank into position in front of the pusher as it moves forward from the position illustrated. During such movement of the separator, the pusher 111 is in a retracted position so that the single blank cammed by the inclined end of the separator 116 can move into a position in alignment with the pusher. The pusher then extends to move the blank into the dies and to hold the blank in position as the working stroke is commenced. While the pusher is injecting a blank into the dies, the pusher extends across the end of the feed chute. While the pusher is in such position, the separator is retracted to allow a single subsequent blank to move down against the side of the pusher and into alignment with the inclined camming surface at the end of the injector.

The operations of the pusher and the injector are timed to the reciprocation of the slide by the cams 33 and 34, illustrated in FIG. 2. These cams are individually connected to the associated levers 113 and 118 to cause timed operation of the pusher 111 and separator 116.

FIG. 10 illustrates one of the cam follower drives. However, a similar drive system is provided for each of the levers. Each of the drives includes a cam follower roller 122 journaled on the end of a follower arm 123 mounted on a pivot 125. Such roller 122 engages the periphery of the associated cam 33 or 34, and moves with oscillating rotation as the cams rotate with the camshaft 27. The movement of the follower arm 123 is transmitted by a push rod 124 to a rocker arm 126 having one arm of which extends generally horizontally into alignment with the push rod. The rocker arm 126 provides a second arm 127 which extends generally vertically. The upper ends of the arms 127 are connected to the associated lever 113 or 118 by a link 128. The ends of such links 128 are provided with swivel bearings, since the movement of the two ends are along arcs extending in planes perpendicular to each other.

As illustrated in FIG. 9, a compression spring system 131 is provided to resiliently bias the lever 113 to the left, as viewed therein, and in turn provides the resilient force urging the pusher 111 toward its operated position.

A similar spring system 132 applies a resilient force to urge the lever 118 toward its operated position. Both of these spring systems 131 and 132 are preloaded by a lever 133 during the normal operation of the machine.

A hydraulic actuator 134 operates to maintain the lever 133 in the illustrated operative position during machine operation. However, when it is necessary to service the tooling, the actuator 134 is allowed to extend by releasing the hydraulic pressure applied thereto. This allows clockwise movement of the lever 133 and relieves the preload on the two spring systems 131 and 132 to remove any hazardous conditions during the servicing of the machine tooling.

In operation, the cams 33 and 34 function to retract the associated of the pusher 111 and separator 116, and the spring systems 131 and 132 provide the extending forces. Therefore, damage to the apparatus does not normally occur if a jam prevents extension of the pusher and/or separator.

The pusher 111 and the separator 116, along with the feed chute assembly 121, are mounted within the machine for ease of removal and replacement. Therefore, when the machine is to be changed over to run blanks of differing sizes, the changeover can be quickly and easily accomplished by removing these components and replacing them with components sized and adjusted in separate jigs for the new size of blank to be rolled. Further, since each of the dies 73 and 78 is positioned within the machine with appropriate spacers, a full changeover can be accomplished quickly and without difficulty.

By utilizing spacers for rough positioning of the dies and then using the various adjustments for the fine adjustment or fine tuning of the relative die positions, it is not necessary to provide the adjustment means with large adjusting ranges. Further, the elimination of the need for shims to adjust pitch, tilt, and parallelism substantially reduces the time and skill required to achieve optimum set-up. Still further, die match can be established and maintained with ease. Therefore, machines in accordance with the present invention are capable of reliably producing high quality thread and down-time for adjustment or changeover is greatly diminished, resulting in more efficient utilization of the machine.

Figure 11:
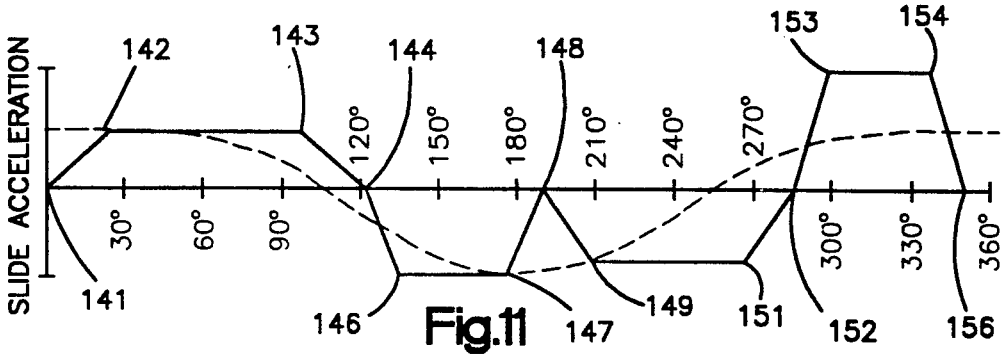
FIG. 11 is an acceleration curve illustrating slide acceleration during each cycle provided by the cam drive and illustrating the comparison of such acceleration to the acceleration occurring in a typical crank-driven thread rolling slide.
Figure 12:
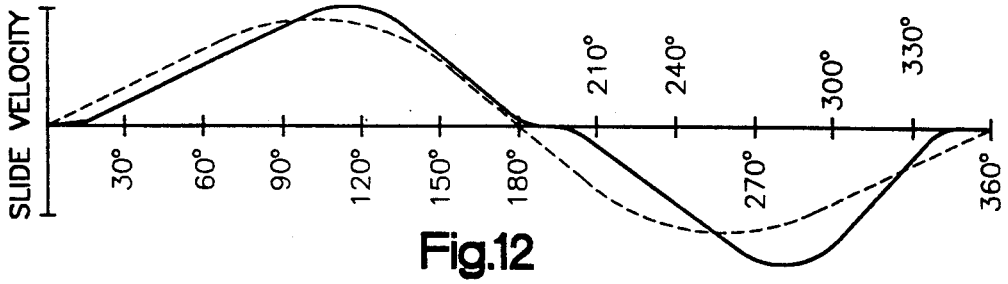
FIG. 12 is a velocity curve of the slide incorporating the cam drive and also comparing the velocity curve existing in a typical crank-driven reciprocating slide.
Figure 13:
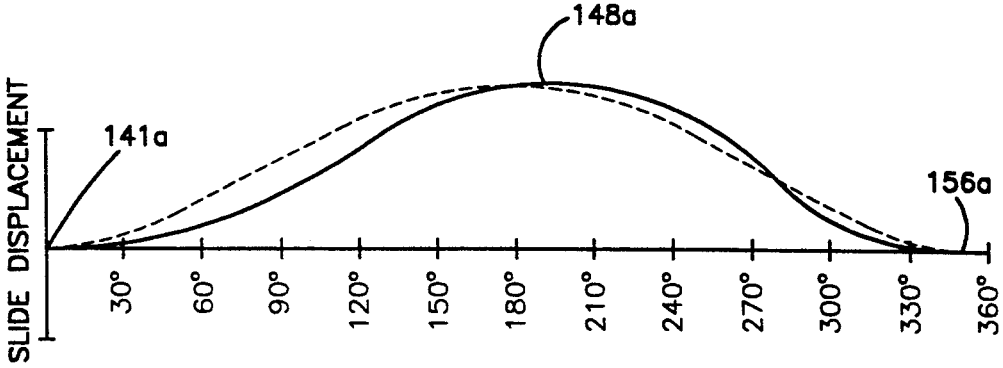
FIG. 13 is a diagram illustrating the displacement curve of the slide and also providing a comparison with the typical displacement curve provided with a crank-driven mechanism.

FIGS. 11, 12, and 13 illustrate, respectively, the acceleration, velocity, and displacement diagrams of the slide, preferably provided in a thread roller incorporating the present invention. These diagrams result from the design of the cams 31 and 32 in combination with the connecting follower linkage which drives the slide through repeated cycles of operation during each revolution of the camshaft 27. During each cycle, the slide is driven first through a working stroke during which a workpiece or blank is rolled between the two dies to form threads thereon. After the working stroke, the slide moves through a return stroke back to its initial position.

In FIG. 11, the acceleration curve provided by the cam and follower linkage drive is shown in full-line, and the dotted line represents the acceleration curve provided in a typical prior art crank and pitman type thread roller. The acceleration at the beginning of the cycle at point 141 is zero. From the beginning of the cycle at point 141, the acceleration increases at a substantially uniform rate to the point 142, when the crankshaft has rotated through about 25 degrees. From the point 142 to the point 143, at about 100 degrees of crankshaft rotation, the acceleration remains constant. Thereafter, the positive rate of acceleration is decreased in a substantially uniform manner to the point 144, where the positive acceleration returns to zero. This occurs at about 125 degrees of crankshaft rotation. Thereafter, negative acceleration or deceleration increases at a substantially uniform rate to the point 146 at about the 130-degree position of the crankshaft. From the point 146 to the point 147, the negative acceleration or deceleration remains constant to the point 147 corresponding to about the 175-degree rotational position of the crankshaft. The rate of deceleration then decreases to the point 148 at about the crankshaft rotational position of 195 degrees.

At this point in the cycle, the slide has reached the end of its working stroke and is momentarily stationary in its fully extended position. Further, the rate of deceleration is reduced to zero as the slide reaches the end of the working stroke. From the point 148 to the point 149, the rate of negative acceleration increases in a substantially uniform manner to the point 149 at about the 210-degree crankshaft position. Thereafter, a constant rate of negative acceleration is maintained to the point 151 at about the 265-degree position of crankshaft rotation.

From the point 151 to the point 152, the negative acceleration rate is decreased in a substantially uniform manner to the point 152 at about the 285-degree position of crankshaft rotation. Thereafter, positive acceleration continues to decelerate the slide with a substantially constant, increasing rate to the point 153 at about the 295-degree position of crankshaft rotation. This continues the deceleration of the slide during its return stroke.

From the point 153 to the point 154, a constant rate of positive acceleration occurs, followed by a decrease in the rate of positive acceleration, to the point 156 at about the 350-degree position of crankshaft rotation. At this point in the cycle, the slide has completed its return stroke and is held stationary in position to receive a subsequent blank for the remaining 10 degrees of crankshaft rotation.

Consequently, the slide dwells in position in which blanks are moved into position for rolling. However, since the slide remains stationary for these 10 degrees of the cycle, the exact timing of the pusher in inserting the blank into the dies is not critical. With this dwell it is possible to reliably position a blank for rolling while the slides and movable die carried thereby are stationary.

Referring now to the dotted acceleration curve normally existing with a crank and pitman drive, the acceleration at the end of the return stroke of the slide has a substantial value, and the slide immediately commences the working stroke at the end of the return stroke. Therefore, it is much more difficult to ensure that a blank is properly positioned for rolling during the subsequent working stroke. Still further, since the acceleration is at a high rate at the commencement of the working stroke, there is a tendency for slippage to occur between the workpiece and the dies at this critical point in the thread rolling operation when initial gripping of the blank occurs.

Further, in a crank and pitman drive, the working stroke only continues through 180 degrees of rotation of the crankshaft and the return stroke continues for the remaining full 180 degrees of crankshaft rotation. This is clearly illustrated in FIG. 12 and FIG. 13, wherein the dotted lines represent the slide velocity and slide displacement.

With the present invention, however, the working stroke continues from the points 141*a* to 148*a* through more than one-half of the cycle to about the position of crankshaft rotation at about 190 degrees. On the other hand, the return stroke, in which work is not being performed and bearing loads are therefore lower, is shortened to extend only from 148*a* to 156*a* from about the position of crankshaft rotation at about 190 degrees to about the 350-degree position. Therefore, the return stroke is accomplished in about 160 degrees of crankshaft rotation. This permits the dwell to be provided for the insertion of blanks without sacrificing the period of the cycle devoted to the thread rolling operation.

With this drive system, a dwell is provided to ensure reliable positioning of a blank for rolling a thread thereon and the likelihood of slippage between the blank and the dies at the commencement of the working stroke is virtually eliminated. Since slippage normally is encountered only at the commencement of the working stroke as the dies commence to grip the blank, reliable match is achieved and a high quality thread is formed in a reliable manner.

It should be understood that the exact configuration of the acceleration diagram illustrated represents one preferred embodiment of this invention, but that it is important that a dwell be provided prior to the commencement of the working stroke and that the rate of acceleration at the commencement of the working stroke should be relatively low to ensure that slippage does not occur between the blank and the dies as the dies commence to grip the blank and commence the thread rolling operation.

Figure 14:
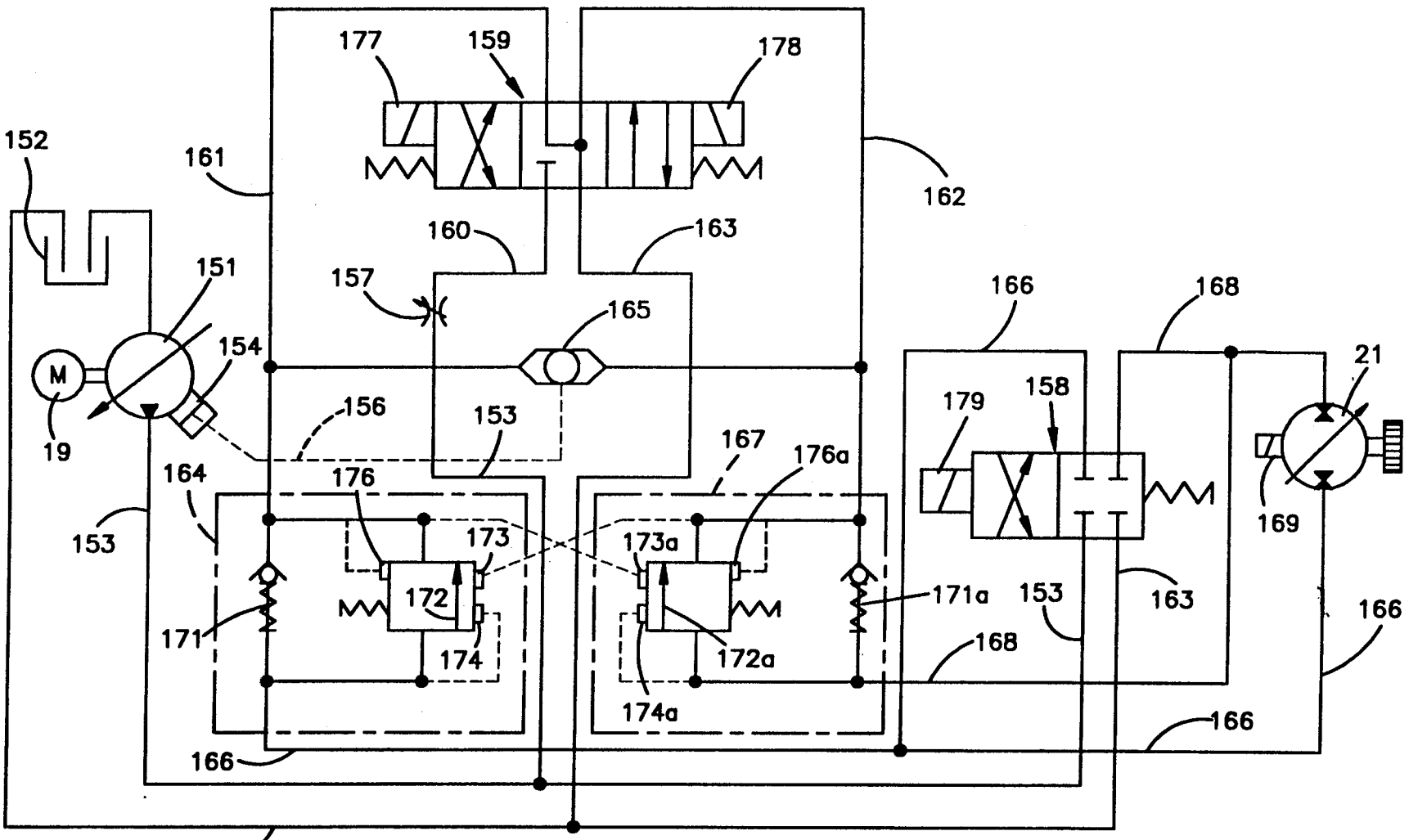
FIG. 14 is a schematic diagram of the hydraulic control circuit for the machine which permits effective jogging and running control of the machine.

FIG. 14 schematically illustrates a preferred hydraulic control circuit for controlling the operation of the thread roller during jog operation in two directions and for controlling the speed of the thread roller during normal running operation. A hydraulic pump 151 is driven by the motor 19 and operates to pump hydraulic fluid from a reservoir 152. The pump delivers fluid under pressure to a fluid supply pressure line 153. The pump 151 is a variable volume pump having a pressure-responsive control 154 which operates to vary the volumetric output of the pump based upon a differential pressure existing between the pressure in the pressure line 153 and a control line 156. The manner in which this control functions is discussed in detail below.

The pressure line 153 has two branches, one of which is connected to the upstream side of an adjustable orifice 157 and the other of which is connected to a run valve 158. The downstream side of the adjustable orifice 157 is connected to an input port of a jog valve 159 by a pressure line 160.

One output port of the jog valve 159 connects with a pressure line 161 and the other output port of the jog valve 159 is connected to a pressure line 162. The fourth port, or reservoir return port, of the jog control valve 159 is connected to a reservoir return line 163. The reservoir return line 163 is also connected to the run valve 158. The pressure line 161 is connected to one side of a shuttle valve 165 and to a first counterbalance valve with pilot assist 164. The other side of the first counterbalancing valve 164 is connected through a pressure line 166 to one side of the motor 21 and to one output port of the run valve 158.

The other pressure line 162 is connected to a second counterbalance valve with pilot assist 167. The other side of the counterbalance valve 167 is connected through a pressure line 168 to the other side of the motor 21 and to the run valve 158.

The hydraulic motor 21 is a variable speed motor having an electrically operated speed control 169, which operates to control the displacement and, in turn, the speed of the motor during normal running operation by adjusting the volume of fluid required to produce one revolution thereof.

Each of the counterbalance valves 164 and 167 19 includes, respectively, check valves 171 and **171*a* allowing free forward flow, and pilot operated relief valve portions 172 and 172*a* which modulates the pressure of the return flow. For example, the counterbalance valve 164 provides a first pilot 173 connected to the pressure line 162 and a second pilot 174 connected to the pressure line 166. A third pilot 176 on the valve 164 connects with the pressure line 161**.

The first pilot **173*a* of the counterbalancing valve 167 is connected to the pressure line 161, while the second pilot 174*a* connects with the pressure line 168. A third pilot 176*a* connects the pressure line 162**.

The shuttle valve 165 operates to connect the pressure line 162 to the control line 156 when the pressure in the pressure line 162 exceeds the pressure in the pressure line 161. Conversely, when the pressure in the pressure line 161 exceeds the pressure in the pressure line 162, the shuttle valve connects the control line 156 to the pressure line 161.

The two counterbalancing valves 164 and 167 function to prevent cavitation if the load on the motor 21 tends to overrun (to run faster than the fluid supply coming from the pump). They also provide hydraulic load holding to lock the motor when the directional control valves are centered.

The jog valve 159 is an electrically operated valve which is spring-centered and is operable from the center position in both directions by electric solenoids 177 and 178. In the center, or neutral, position, the jog valve connects the pressure lines 161 and 162 to the reservoir return line 163.

When the solenoid 177 is actuated causing the valve to shift to the right, the two pressure lines 160 and 162 are connected together, and the two pressure lines 163 and 161 are connected together. Conversely, when the solenoid 178 is actuated, the valve shifts to the left and causes a connection between the pressure line 160 and 161, while the pressure lines 162 and 163 are connected together. The jog valve 159 is a four-way valve, so that jogging can be produced in both directions during the set-up of the machine.

The run valve 158, however, is a single-acting valve which isolates all of the associated pressure lines in its normal position. It provides a single solenoid 179 which operates when energized to connect the two pressure lines 153 and 168 and also connects the two pressure lines 163 and 166.

During normal run operations, the two solenoids 177 and 179 are energized. In such condition, the pump output pressure is supplied by the run valve 158 directly to the pressure line 168 so the motor is supplied with full pump pressure and output volume. In such condition, the exhaust or discharge from the motor 21 passes through the pressure line 166 through the run valve 158 directly to the reservoir return line 163. During such run operation, the output pressure of the pump is also supplied to the pressure line 153, the adjustable orifice 157, and through the jog valve 159 to the pressure line 162. However, in such condition, there is substantially no flow through this portion of the circuit, since the pressure line 168 downstream from the valve **171*a* of the counterbalance valve 167 is already at pump output pressure by virtue of the connection provided by the run valve. Therefore, the control line pressure 156 is equal to, or substantially equal to, the pump output pressure. In such situation, the pressure-responsive control 154 on the pump causes the pump to operate at full volumetric output and the orifice 157 is, in effect, bypassed. The speed of the thread roller is then controlled by the electrical control 169 on the motor 21**. Such electrical control permits the operator to control the speed of the thread roller at any desired speed within its range of operating speeds.

When jogging is required, the electrical control 169 is operated by the electrical control circuit to cause the motor to operate at its lowest speed within its range of adjustment. For forward jogging, the solenoid 177 is actuated, causing the jog valve 159 to shift to the right, as viewed in FIG. 14. In such position, the output of the pump passes through the adjustable orifice 157 to the pressure line 162, and through the check valve 171*a* of the counter-balance valve 167 to the pressure line 168, from which it flows to the motor. The exhaust or discharge fluid from the motor 21 then passes through the pressure line 166 to the counterbalance valve 164. In such condition, the pilot 173 causes the bypass valve portion to shift and connect the pressure lines 166 and 161. The exhaust then passes through the shifted jog valve 159 to the reservoir return line 163.

Since the pressure in the pressure line 162 is higher than the pressure in the pressure line 161, the shuttle valve shifts to the left, connecting the control line 156 to the pressure line 162. During such operation, all of the fluid passes through the orifice, producing a pressure drop which is a function of flow. Therefore, the control line 156 is at a pressure lower than the output pressure of the pump by an amount equal to the pressure drop across the adjustable orifice 157.

If the speed of jogging is higher than desired, caused by excessive output volume of the pump 151, this pressure drop across the adjustable orifice supplied to the control line 156 is too great. This causes the pressure-responsive control 154 to decrease the pump output. On the other hand, if the output of the pump is less than desired, the pressure drop across the orifice 157 has a low value and causes the pressure-responsive control 154 to increase the volumetric output of the pump. Consequently, by adjusting the orifice 157, it is possible to control the speed of jogging.

Normally, jogging is performed at slow speed, so the orifice is adjusted to a low pump output position. However, since the pressure output of the pump available is the maximum pressure of the pump, full pressure is potentially available to cause the machine to be operated at the jogging speed. Further, since the motor 21 is at the lowest speed of operation for given volume of hydraulic fluid, high torque is available. In fact, in practice, sufficient torque is available to cause jogging under any expected loading condition.

For reverse jog operation, the solenoid 178 is operated to shift the jog valve 159 to the left. This causes the output flow from the pump to be again directed through the adjustable orifice 157. However, for reverse direction jogging, the downstream side of the orifice is connected through the jog valve 159 to the pressure line 161, and through the check valve 171 of the counterbalancing valve 164, to the pressure line 166. Therefore, the supply pressure is connected to the opposite port of the motor 21 and reverse rotation is produced. In such condition, the exhaust from the hydraulic motor 21 passes through the line 168 and the shifted relief valve portion 172*a* of the counterbalancing valve 167 to the pressure line 162. In such position, the pressure line 162 is connected to the reservoir return line 163.

During reverse jogging operation, the shuttle valve is shifted to the right, connecting the control line 156 to the pressure line 161. Here again, if the pump output is excessive for jogging, the pressure drop across the orifice increases, causing the pressure-responsive control 154 to decrease the volumetric output of the pump 151. On the other hand, if the flow rate is too small, causing slower than desired jogging speed, the pressure drop across the orifice decreases and results in an increased output of the pump 151. Maximum torque is again available for reverse jogging operation.

With this simple control circuit, the speed of jogging is controlled by the adjustable orifice and maximum torque is available for the jogging operation. For normal running operation, however, the pump automatically moves to its maximum output and the speed of the thread roller is controlled by the adjustment of the motor 21.

In the event that overrunning machine loads tend to drive the motor 21 at a speed greater than the flow rate provided by the jog control circuit would allow, then the pressure in pilot line 173 or 173*a* decreases. In such instance, the relief valve portion of the counterbalancing valve in the exhaust circuit begins to close, increasing pressure in line 166 or 168 which prevents such overrunning operation while in the jog mode.

It is within the broader aspects of the present invention to produce machines for various die sizes which provide identical frames and most other identical component parts. The change of the stroke of the slide is accomplished by merely substituting appropriate cams and appropriately sized die pockets are provided. Therefore, economies of manufacture can be achieved, since substantial numbers of component parts of the machine can be produced for inventory and selectively installed in machines constructed for various sizes of dies. As mentioned previously, machines constructed to operate with three different die sizes are virtually identical with respect to most of the significant component parts and a full range of five different die sizes can be covered by two basic machine sizes.

Although the preferred embodiment of this invention has been shown and described, it should be understood that various modifications and rearrangements of the parts may be resorted to without departing from the scope of the invention as disclosed and claimed herein.

What is claimed is:

1. A thread roller comprising a frame, a movable die carrier mounted on said frame, a movable die pocket on said movable die carrier for supporting a movable die for movement with said movable die carrier, a stationary die support on said frame having a stationary die pocket for supporting a stationary die, an adjustment means for adjusting the position of said stationary die pocket relative to said movable die pocket to adjust die tilt, die parallelism, and die pitch, said adjustment means permitting adjustment of pitch without affecting tilt and parallelism adjustment and a power drive operating said die carrier to reciprocate a movable die located in said movable die pocket relative to a stationary die mounted in said stationary die pocket through repeated cycles, each including a working stroke and a return stroke of predetermined length, said power drive operating to adjust the position of said strokes relative to said fixed die pocket without materially changing of the length of said strokes to adjust die match while said machine is running, said dies operating to produce threads on a blank rolled between said dies during said working stroke.

2. A thread roller as set forth in claim 1, wherein said power drive operates to maintain said die carrier substantially stationary for a predetermined period of time during which a pusher operates to position blanks between said dies.

3. A thread roller comprising a frame, a movable die carrier having a movable die pocket adapted to support a movable thread rolling die, a stationary die block on said frame providing a stationary die pocket adapted to support a stationary thread rolling die, first adjustable means adjustably positioning the position of said stationary die pocket to separately adjust tilt and parallelism of dies in said die pockets, and second adjustable means operating to adjust die pitch without affecting said first adjusting means, a thread rolling die in each of said die pockets, power means for reciprocating said movable die pocket and the die contained therein through working stroke and return stroke so that blanks are rolled between said dies and threaded during said working stroke, said tilt and parallelism adjustment including a back-up plate and a wedge between said back-up plate and frame operating to adjust pitch without changing the adjustment of tilt and parallelism, clamp means operating to clamp said back-up plate against said wedge with a first predetermined force during normal operation and with a lower predetermined force while said wedge is being adjusted, said lower predetermined force being sufficiently great to allow continued running operation of said thread roller during adjustment of said wedge.

4. A thread roller as set forth in claim 3, wherein said tilt and parallelism adjustment includes said back-up plate and at least three adjusting elements operating between said die block and said back-up plate to adjust the position of said die block relative to said back-up plate.

5. A thread roller as set forth in claim 4, wherein said tilt and parallelism adjustment includes a fixed pin, adjustment of one pair of said three adjustment elements operating to adjust tilt, and adjustment of another pair of said adjustment elements operating to adjust parallelism.

6. A thread roller as set forth in claim 3, wherein said second adjustment means includes a wedge between said back-up plate and frame operating to adjust pitch without changing the adjustment of tilt and parallelism.

7. A thread roller as set forth in claim 3, wherein said lower predetermined force is provided by mechanical springs and said first predetermined force is provided by said mechanical springs and hydraulic pressure.

* * * * *